US011059638B2

(12) United States Patent
Spallek et al.

(10) Patent No.: US 11,059,638 B2
(45) Date of Patent: Jul. 13, 2021

(54) CONTAINER

(71) Applicant: KOCHER-PLASTIK MASCHINENBAU, Sulzbach-Laufen (DE)

(72) Inventors: Michael Spallek, Ingelheim (DE); Johannes Geser, Gerlingen (DE); Philipp Spreng, Neu-Ulm (DE)

(73) Assignee: KOCHER-PLASTIK MASCHINENBAU GMBH, Sulzbach-Laufen (DE)

( * ) Notice: Subject to any disclaimer, the term of this patent is extended or adjusted under 35 U.S.C. 154(b) by 0 days.

(21) Appl. No.: 16/338,516

(22) PCT Filed: Dec. 13, 2017

(86) PCT No.: PCT/EP2017/001425
§ 371 (c)(1),
(2) Date: Apr. 1, 2019

(87) PCT Pub. No.: WO2018/127267
PCT Pub. Date: Jul. 12, 2018

(65) Prior Publication Data

US 2019/0225390 A1 Jul. 25, 2019

(30) Foreign Application Priority Data

Jan. 5, 2017 (DE) ..... 10 2017 000 048.4

(51) Int. Cl.
*B65D 51/00* (2006.01)
*A61J 1/14* (2006.01)

(52) U.S. Cl.
CPC ..... *B65D 51/002* (2013.01); *A61J 1/1406* (2013.01)

(58) Field of Classification Search
CPC ..... B65D 51/002; A61J 1/1406
See application file for complete search history.

(56) References Cited

U.S. PATENT DOCUMENTS 3,509,879 A * 5/1970 Bathish ..... C08L 77/00 604/408
3,905,368 A * 9/1975 Lewis, Jr. ..... A61J 1/1431 604/415

(Continued)

FOREIGN PATENT DOCUMENTS

DE 197 54 625 6/1999
DE 10 2004 051 300 11/2005

(Continued)

OTHER PUBLICATIONS

International Search Report dated Mar. 13, 2018 in International (PCT) Application No. PCT/EP2017/001425.

*Primary Examiner* — James N Smalley
(74) *Attorney, Agent, or Firm* — Wenderoth, Lind & Ponack, L.L.P.

(57) ABSTRACT

A container has an at least partially filled container body and at least one cap part (10). The cap part has at least one sealing part (16) that, for removal of the container contents, can be penetrated by a hollow-spike-shaped insertion part (22) from the outside, with a predeterminable actuating force, in an introduction direction. The insertion part can be removed from the container again, with a predeterminable pull-out force, in an oppositely directed pull-out direction. A device (16, 18) makes it difficult for the insertion part (22) to be removed with the pull-out force being increased such that unintentional removal of the insertion part (22) is at least made difficult.

24 Claims, 7 Drawing Sheets

(56) References Cited

U.S. PATENT DOCUMENTS

| | | | | | |
|---|---|---|---|---|---|
| 4,501,372 | A * | 2/1985 | Hansen | B65D 51/002 215/247 |
| 4,545,497 | A | 10/1985 | Martha, Jr. | |
| 5,025,955 | A * | 6/1991 | Stenger | B67B 7/26 222/400.8 |
| 5,232,109 | A | 8/1993 | Tirrell et al. | |
| 5,395,365 | A | 3/1995 | Weiler et al. | |
| 5,678,713 | A * | 10/1997 | Derksen | A61J 1/1406 215/249 |
| 5,895,383 | A | 4/1999 | Niedospial, Jr. | |
| 2002/0113033 | A1 | 8/2002 | Claessens | |
| 2004/0112855 | A1 * | 6/2004 | Becker | B65D 51/002 215/247 |
| 2009/0054865 | A1 * | 2/2009 | Brandenburger | B65D 51/002 604/415 |
| 2011/0245796 | A1 * | 10/2011 | Brandenburger | A61J 1/1418 604/414 |

FOREIGN PATENT DOCUMENTS

| | | |
|---|---|---|
| DE | 10 2014 003 501 | 4/2015 |
| EP | 0 573 102 | 12/1993 |
| EP | 1 457 429 | 9/2004 |
| EP | 1 955 964 | 8/2008 |
| WO | 01/76967 | 10/2001 |
| WO | 2005/087127 | 9/2005 |
| WO | 2014/114685 | 7/2014 |

* cited by examiner

CONTAINER

FIELD OF THE INVENTION

The invention concerns a container that is at least partially filled and closed, and manufactured in particular according to a blow-molding, filling and sealing process. A container body is at least partially filled. The end of the container body is at least partially closed through a head diaphragm and comprises a cap part with a sealing part. For removal of the container contents, the sealing part may be penetrated with a hollow, spike-shaped insertion part ("spike") from the outside in an insertion direction with a predeterminable actuating force. The insertion part may be removed again with a predeterminable retraction force in an opposite retraction direction.

BACKGROUND OF THE INVENTION

Containers that are made from plastic according to the Blow-Fill-Seal (BFS) method, which is also known as the Bottelpack® method, are widely used for medical purposes, for example in form of infusion bottles. Such containers are particularly suitable for medical applications because the filling material comes only into contact with a polymer. Containers of this kind are prior art. U.S. Pat. No. 5,395,365, for example, describes a container of this kind. To ensure that the usability of such containers in medical operations is simple and safe, the sealing part must provide a secure seal during and after insertion with the insertion part of an infusion device, which is described by way of example in EN 8536-4.

Two further requirements, which are contradictory in principle, must be met simultaneously. First, that the insertion force is kept as low as possible. Second, the retraction of the insertion part is only possible against suitably high retraction forces. High retaining forces or good grip must be ensured to provide the patient with a certain level of mobility during the often lengthy process of infusion administration so that the patient is able to move freely without interrupting the infusion by unintentionally pulling out the infusion device. According to the standard ISO 15759:2006, the retaining force of the infusion device, therefore, must not be less than 15 N. This standard, on the other hand, permits insertion forces of up to 80 N.

The attempt to provide a sufficiently high retaining force by accepting a high insertion force is not practical because high insertion forces cannot be achieved by the nursing staff, especially when wearing gloves. These contradictory requirements, that is, easy to insert but difficult to retract, can also not be met by other simple measures such as arrow-shaped insertion parts with undercuts or barbs since this shape could lead to leakage of the sealing part. Also, such geometrical shape of the insertion part violates the applicable standard EN ISO 8536-4:2013.

Known sealing caps, such as are described in DE 10 2004 051 300 B3, EP 1 457 429 B1 and WO 2014/114685 A1, for example, do not meet the above-described, in principle contradictory, requirements. These documents propose to use a hollow stopper to make the tapping easier. DE 10 2004 051 300 B3 depicts recesses in the elastomer for the insertion spike that are oriented to the outside on one side. EP 1 457 429 B1 and WO 2014/114685 A1 describe that recesses for the insertion spike are provided in the elastomer on one side, oriented towards the container side. There is no apparent mechanism that would increase the retaining force. As FIG. 2 of WO 2014/114685 A1 shows, the retraction of the insertion spike is made rather easier than more difficult through a special funnel-shaped gradation.

SUMMARY OF THE INVENTION

With regard to the above problem, an object of the invention to provide an improved container of the kind described at the outset, which meets these two requirements for the application of the container in a special way.

This object is basically met according to the invention by a container having a device that makes the removal of the insertion part more difficult. The retraction force is increased to such an extent that an inadvertent removal of the insertion part is at least made more difficult. The insertion force is not increased by this device.

In particularly advantageous exemplary embodiments a sealing part, which is a component of the device that makes the removal of the insertion part more difficult, is provided in a cap part of the container body in such a way that, when the sealing part, which is a component of the device, is penetrated, a radial distance is provided between a through-hole in the cap part and the insertion part that was introduced. Also, at least when the insertion part is removed from the container in retraction direction, the radial distance is at least partially packed by the sealing part, which is a further component of the device and which applies at least an increased frictional force on the insertion part, at least in certain sections, during its retraction from the container. Through the displacement of the sealing part material caused by the retraction movement and the filling of the radial distance, a friction and compression zone is formed at the through-hole in the cap part, which impedes the retraction movement.

The through-hole in the cap part may, in conjunction with the outer circumference of the introduced insertion part, advantageously delimit an annular duct. When retrieving the insertion part from the container, the annular duct is completely packed to the surroundings by this further part of the device under formation of a bead-shaped projection that, being jammed in the annular duct, applies an additional clamping force onto the insertion part.

In a particularly advantageous manner, the sealing part is a preferably soft, elastomeric material. The sealing part extends between the cap part and a head diaphragm of a head part of the container, and is preferably provided with a recess at the end that is facing away from head diaphragm of the head part.

In advantageous exemplary embodiments, the sealing part is provided, at its end that faces the head diaphragm of the head part of the container, with a further sealing ring-shaped geometry that is an axially protruding extension of its recess in the direction of the head diaphragm. The geometry can brace itself, at least during the inserting of the insertion part, in a sealing manner against the upper end of the head diaphragm of the container facing it. This structure forms a further seal at the head diaphragm that surrounds the perforation.

The through-hole of the cap part may be covered with respect to the surroundings by a removable strap, a foil or similar member so as to provide a secure cover over the sealing part when the container is stored prior to its use. The following describes mostly embodiments with a strap. However, they may be implemented equally well with a foil.

The cap part, which is preferably made form a rigid plastic material, may be attached to a collar of the container below its head part.

The cap part may advantageously be provided with a second, separate sealing part, for example a sealing part for cannula passage. This second sealing part may be made from a different material than the first one sealing part and/or may have a different geometric shape, and thus, may be easily adapted to the application. The container is therefore suitable for multiple applications, for example the possibility of introducing an additive by piercing the second sealing element, for example by an injection cannula.

The subject of the invention is also a cap part, which is provided for a container according to the invention.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1A:
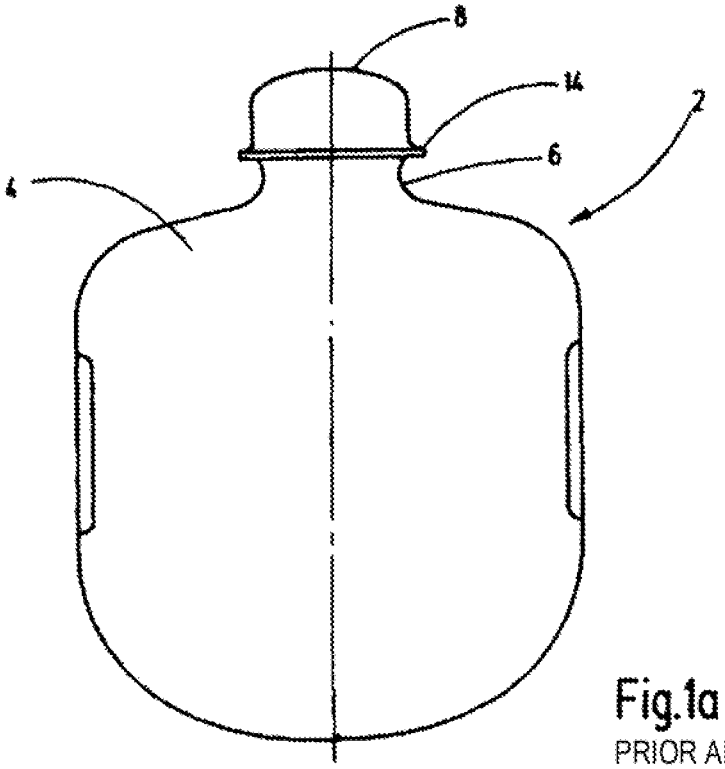
Fig.1a PRIOR ART
FIGS. 1*a, b* are, at approximately half the size, front views of two known infusion containers.
Figure 1B:
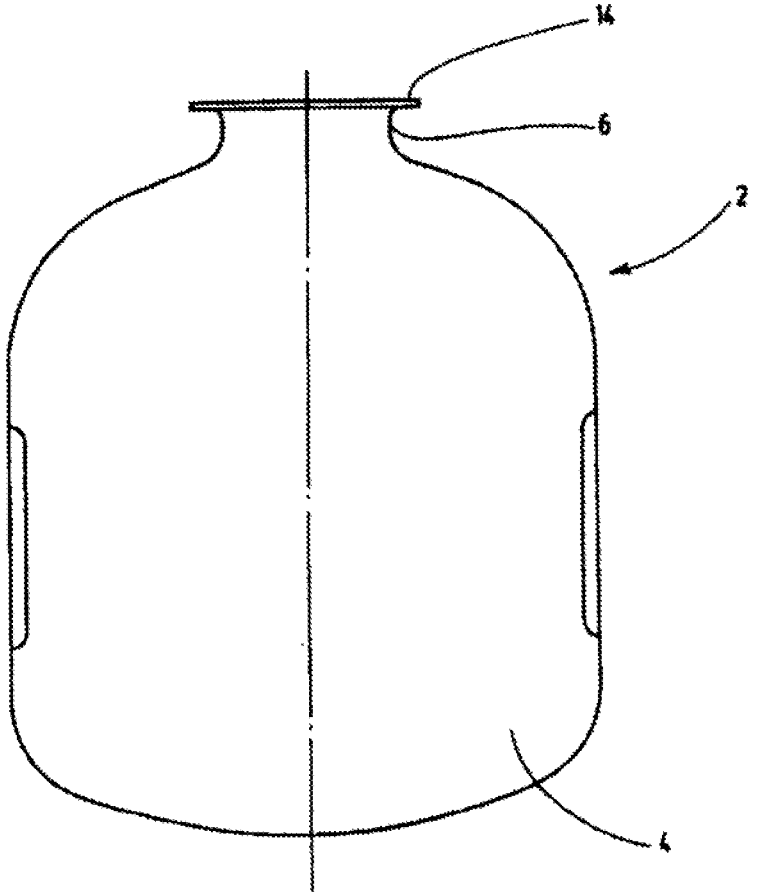
Fig.1b PRIOR ART

The FIGS. 1*a* and 1*b* depict two exemplary embodiments of the plastic container 2 according to the invention, each in form of an infusion container known per se, comprising a bag-like container body 4 and a rim part 14. In the example according to FIG. 1*a*, the head part 6 is comprised of a flexible head diaphragm 8 that is formed in one piece with the remaining container wall. The head diaphragm 8 forms a removal zone for the removal of the contents of the container. Containers of this kind may be manufactured using the known blow-fill-seal technology (BFS technology). In the example according to FIG. 1*b* the head part 6, and thus, the container 4 is open. Such containers are manufactured using the blow-molding technology known per se, preferably the stretch blow-molding technology or the injection stretch blow-molding technology.

Figure 2:
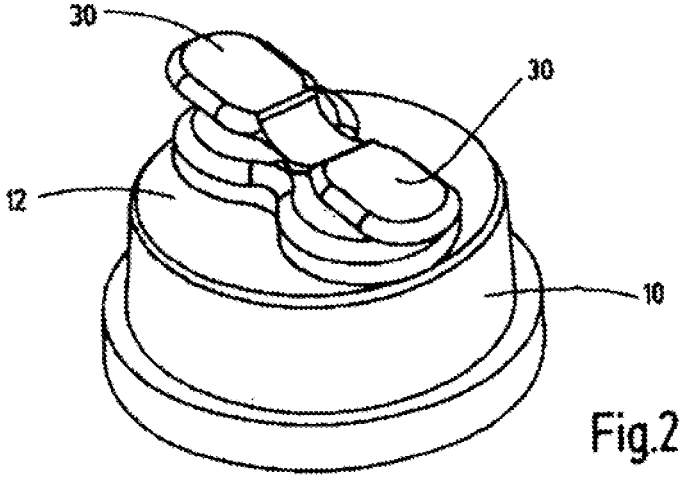
FIG. 2 is a perspective view, slightly enlarged, of a separately shown cap part according to a first exemplary embodiment of the invention.
Figure 3A:
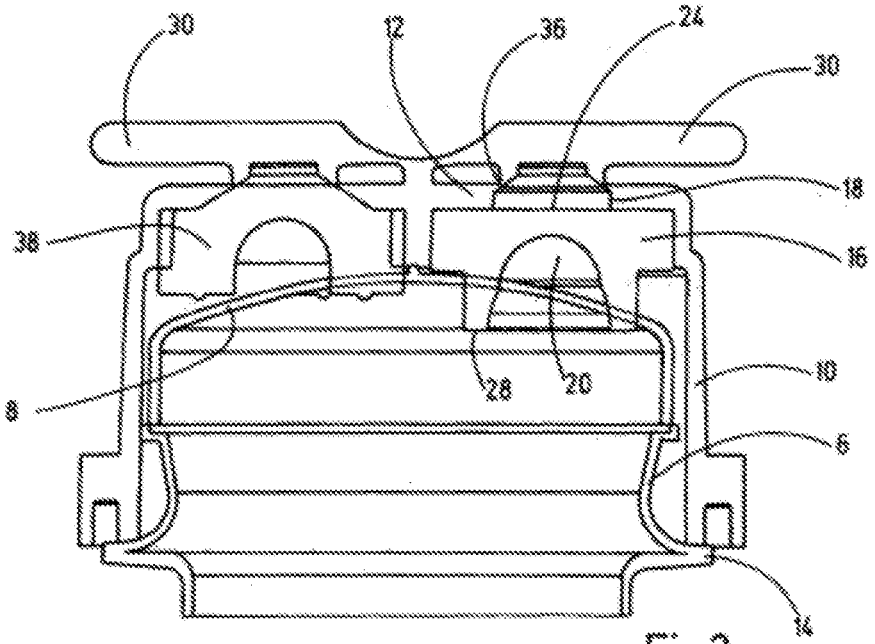
FIGS. 3*a, b* are side views in section each, depicted slightly enlarged, of the head part of the container of FIG. 1*a*, shown with attached cap part of FIG. 2, wherein a flexible head diaphragm of the head part is shown in a non-deformed position prior to the attachment of the cap part.
Figure 3B:
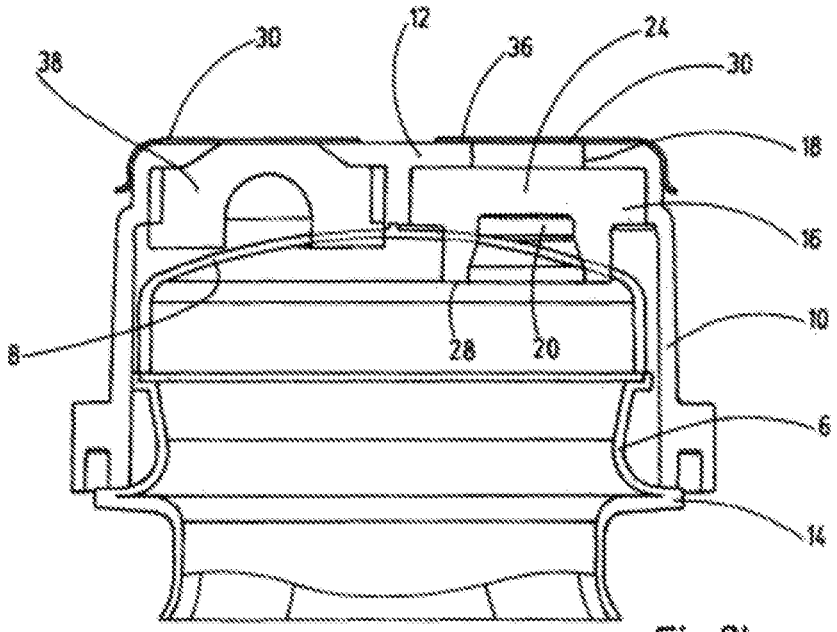

The FIGS. 2 and 3*a, b* each depict a cap part 10, preferably made from a rigid plastic material. The cap part has largely the shape of a circular cup with bottom 12 and detachable straps 30. In FIGS. 3*a, b*, the cap part 10 is attached by way of substance bonding to a radially protruding rim part 14 at the head part 6 of the container 2 according to FIG. 1*a*. Disposed between the inner side of the bottom 12 of the cap part 10 and the head diaphragm 8 is at least a sealing part 16, which provides for the secure removal of the contents of the container 2. The sealing part 16 may be pierced by an insertion part 22 for a removal action. Sealing part 16 forms part of the device that makes the removal of the insertion part 22 from container 2 more difficult and at the same time acts as a seal at the insertion part 22. To this end, the sealing part 16 is made from an elastomeric material with very little rigidity and hardness. In particular, materials such as halogen butyl rubber, synthetic rubber, for example polyisoprene, thermoplastic elastomers, silicon, natural rubber, nitrile rubber, are well suited. Preferred are thermoplastic elastomers, which may be substance-bonded through welding to the cap part 10. Each of the FIGS. 3*a* and 3*b* shows the geometry of the sealing part 16, which is disposed at the bottom 12 of the cap part 10, oriented towards a through-hole 18 of the cap part 10. The through-hole 18 at the bottom 12 of the cap part 10 is covered towards the surroundings by a strap 30. In the example of FIG. 3*a*, strap 30 is made of a solid material. In the example of FIG. 3*b*, strap 30 is made of a foil. The strap 30 is removable from the upper edge 36 of the through-hole 18 to open up the through-hole 18 prior to a removal action. It is of great advantage in both instances, for the upper diameter of the through-hole 18 to be as small as possible so that it is easy for the user to remove the strap 30.

Figure 4A:
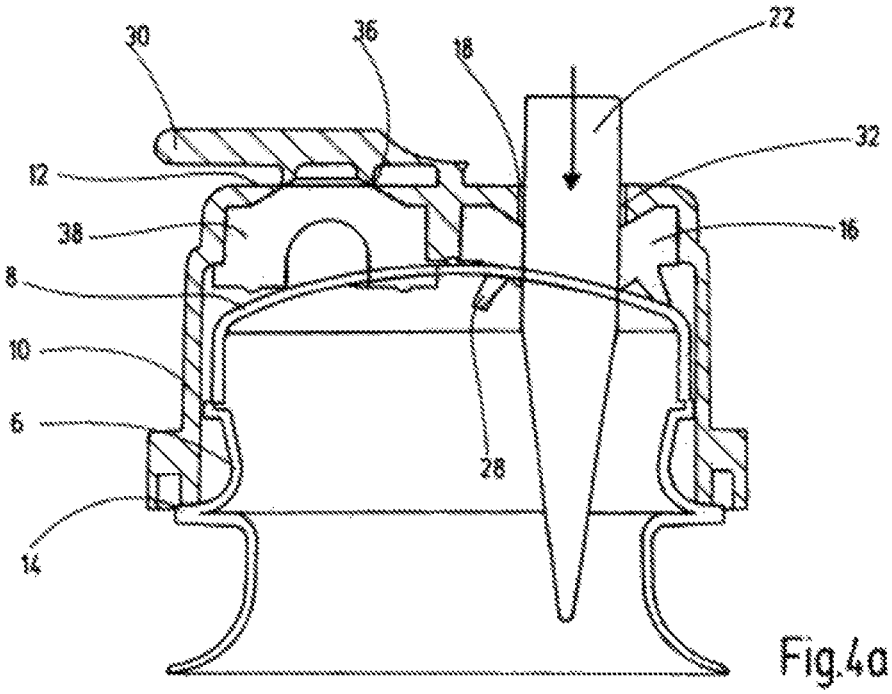
FIG. 4*a* is a side view in section of the container head part and cap part of FIG. 3*a*, which depicts the state during the insertion movement of an insertion part for carrying out a removal action of the container contents.
Figure 4B:
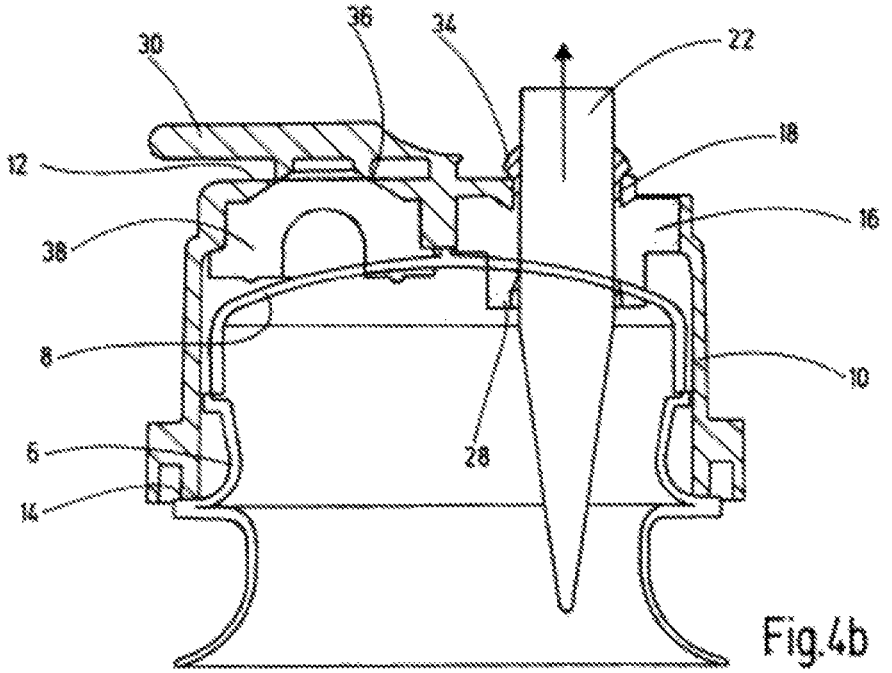
FIG. 4*b* is a side view in section of the container head part and cap part of FIG. 3*a* showing the state during the retraction movement of the insertion part.

On the side of the strap 30, the sealing part 16 is provided with a continuous piercing diaphragm 24, which is penetrated during the removal action. At the side of the head diaphragm 8, the sealing part 16 is provided with a central recess 20, which is flush with the through-hole 18 and which is provided for an insertion part 22 of an infusion device (FIGS. 4*a* and 4*b*). The axially protruding sealing ring geometry 28 of the sealing part 16 seals the removal zone at the head diaphragm 8 of the container head part 6.

The geometry, and in particular the diameter, of the through-hole 18 compared to the diameter of the insertion part 22 is chosen such that (see FIG. 4*a*) an annular duct 32 is formed between the outer circumference of the insertion part 22 and the though-hole 18 as the insertion part 22 penetrates. As shown in FIG. 4*b*, which depicts the state shortly after commencement of pulling the insertion part 22 out, the annular duct 32 is fully packed through the elastically deformed, displaced material of the sealing part 16, which results from the retraction movement. This displaced material causes an additional friction force between the insertion part 22 and the bottom 12 of the cap part 10, as the displaced material forms a bead-like projection 34 on the outside of the bottom 12 as a further impeding friction zone.

Figure 5:
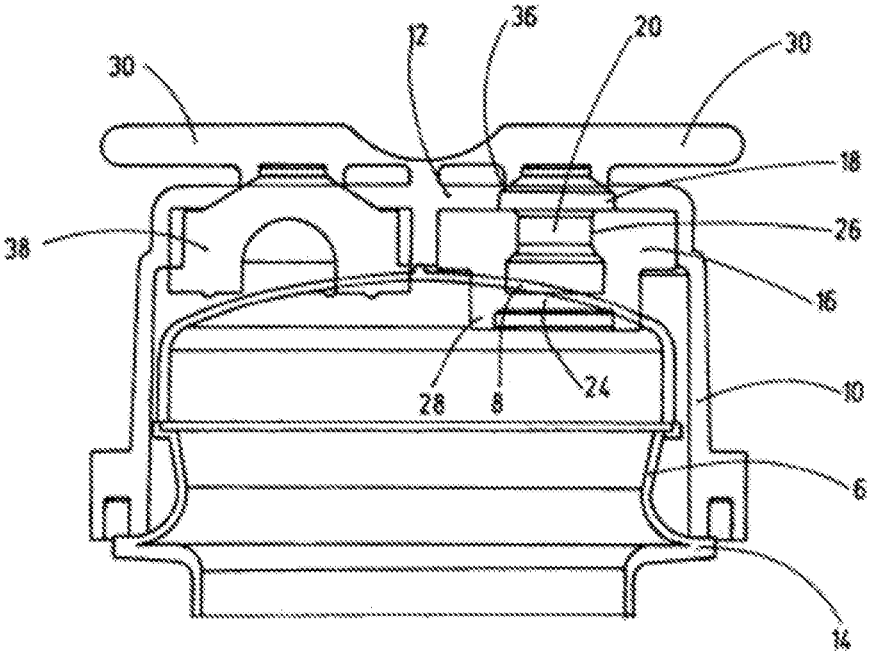
FIG. 5 is a side view in section of a container head part and cap part according to a second exemplary embodiment of the invention, with a sealing element and a changed diaphragm position.

FIG. 5 depicts a special embodiment in which the sealing part 16 is provided with a recess 20 and a sealing bead-shaped geometry 26 disposed directly at the through-hole 18. The free internal diameter of the geometry 26 is substantially smaller than the diameter of the through-hole 18. This causes the material of the sealing part 16, 26, which is moved during the retraction movement, to be pulled into the annular duct 32 (see FIG. 4*b*), which pulling causes an additional friction force that impedes the further retracting of the insertion part 22. A further sealing ring geometry 28 extends from circumferential edge of the diaphragm 24 in the direction of the head diaphragm 8 of the container head part 6.

Figure 6:
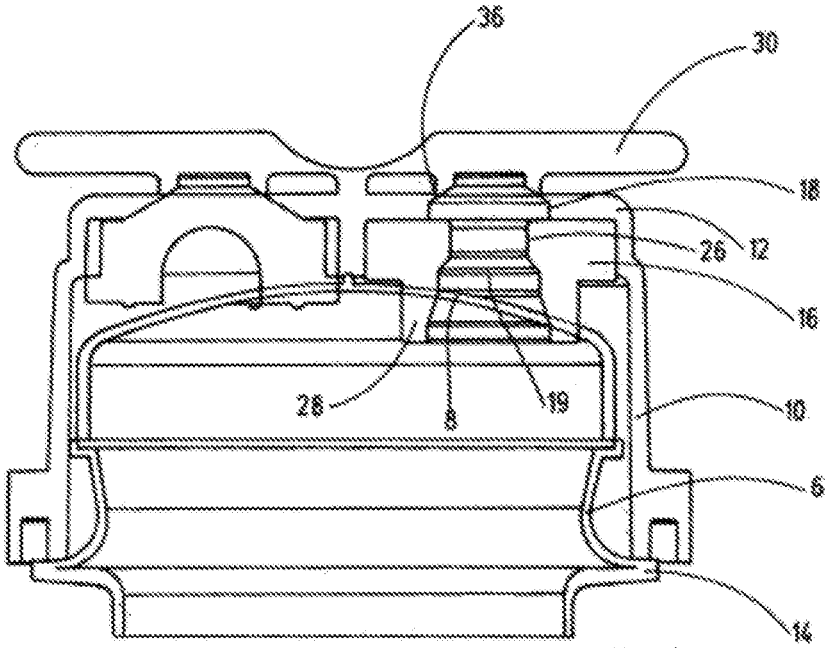
FIG. 6 is a side view in section of a container head part and cap part according to the second embodiment, with a sealing element without a diaphragm.

FIG. 6 depicts a further special embodiment, similar to that of FIG. 5, in which the sealing part 16 is not provided with a diaphragm, but is provided with a passage 19. This passage 19 provides for minimal piercing forces, but at the same time offers high retraction resistance through the sealing bead-shaped geometry 26 of the sealing part 16 close to the through-hole 18 in cap part 10.

Figure 7:
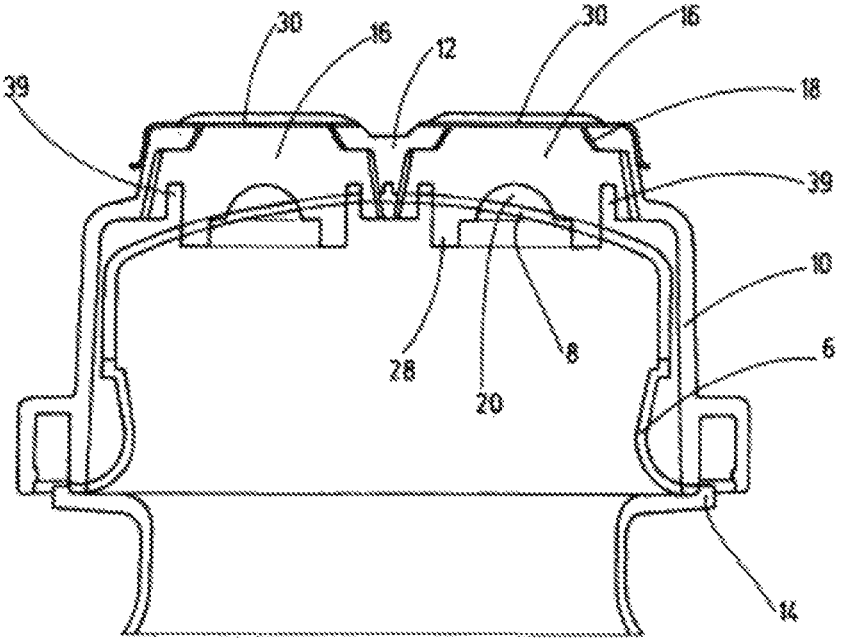
FIG. 7 is a side view in section of a container head part and a cap part according to a third exemplary embodiment of the invention, with special annular groove geometry of both sealing elements and a strap made from foil material.

FIG. 7 depicts a further special embodiment, similar to that of FIG. 3*b*, with two separate sealing parts 16 of the same kind. The trough-hole 18 in cap part 10 has a conical shape, which makes the attachment of the respective sealing part 16 or sealing element to the cap part 10 easier. Because the through-hole 18 is almost completely packed by the sealing part 16, the annular duct 32 is not as deep compared to the embodiment according to FIG. 4*a*. Nevertheless, it was surprising to see that, when retracting the insertion part 22, the annular duct 32 was packed with a bead-like projection 34 similar to FIG. 4*b* and a retraction resistance according to the invention. A circumferential annular groove 39 inside the sealing element 16 has a reducing effect on the piercing forces because a lateral, elastic movement or displacement of the sealing part 16 by the insertion part 22 is possible.

Figure 8:
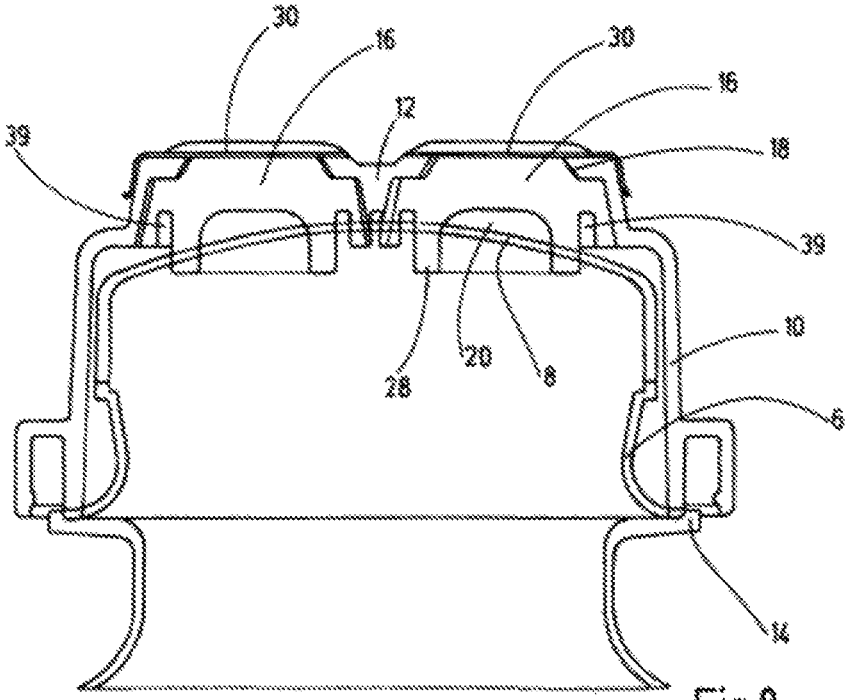
FIG. 8 is a side view in section of a container head part and a cap part according to a fourth exemplary embodiment of the invention, changed compared with the third embodiment of FIG. 7, with special annular groove geometry of both sealing elements and a strap made from foil material.

FIG. 8 depicts a further special embodiment, similar to that of FIG. 7, also with a conical geometry of the through-hole 18 with two separate sealing parts 16 of the same kind but, compared to the example in FIG. 7, with narrower sealing ring geometry 28.

Figure 9A:
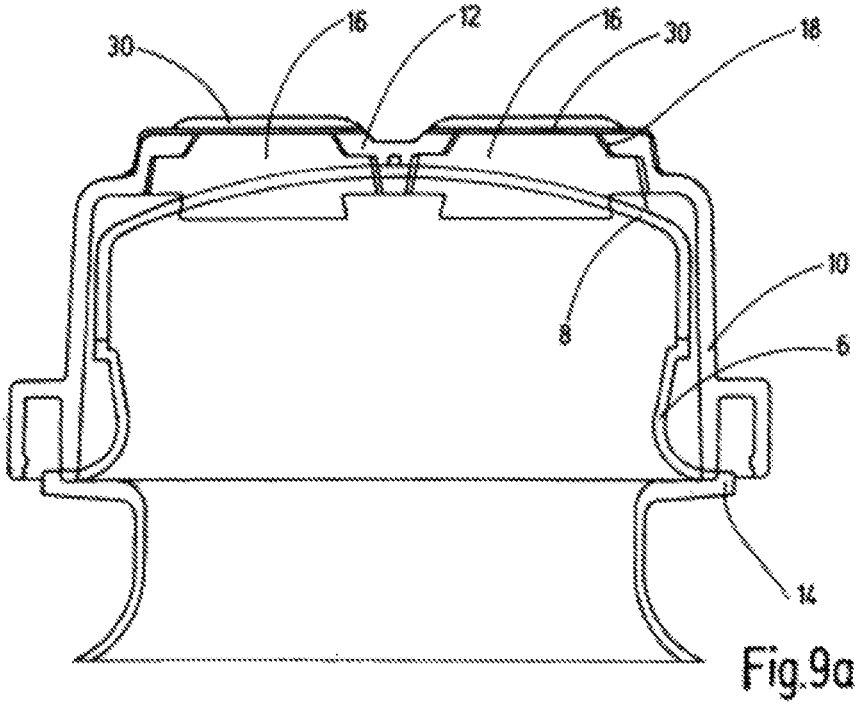
FIGS. 9*a* and *b* are side views in section of a container head part and a cap part according to a fifth exemplary embodiment of the invention, with two sealing elements with a stopper-shaped geometry, affixed to a container according to FIG. 1*a* and FIG. 1*b*, respectively.
Figure 9B:
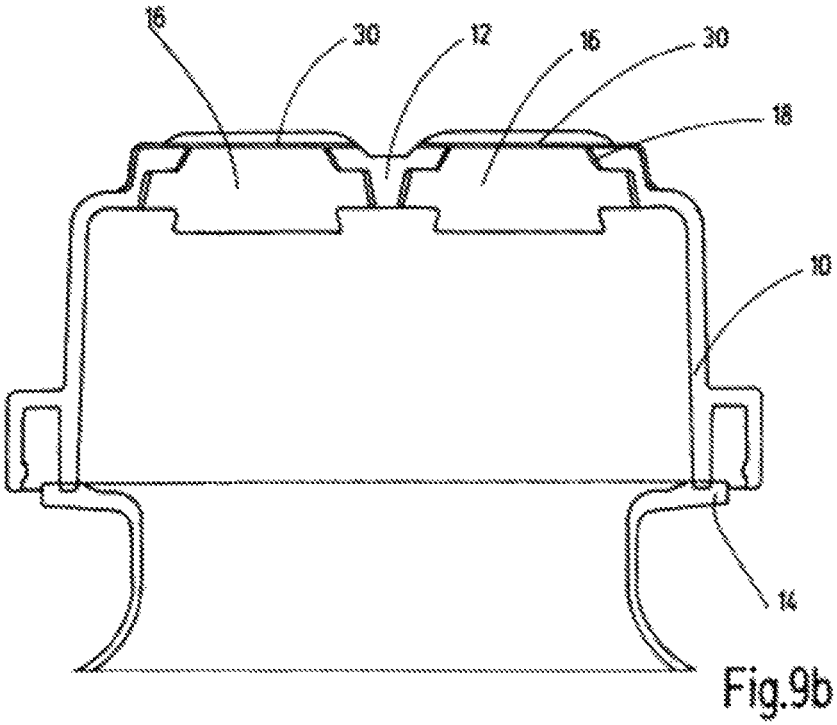

FIGS. 9*a* and 9*b* respectively depict a further special embodiment, similar to that of FIG. 7, with two separate sealing parts 16 of the same kind and with a geometry that is particularly easy to manufacture, attached to a container according to FIG. 1*a* (with head diaphragm 8) and FIG. 1*b* (without head diaphragm) respectively.

It came as a surprise to realize that an easy removal of the strap 30, a small piercing force and an advantageous increase of the retraction force of the insertion part 22 is only achieved through the synergistic interaction of the following multiple factors:

1—Material characteristics of the sealing part 16, in particular Shore hardness;

2—Geometric design of the through-hole 18, 36;

3—Attachment of sealing part 16 at the bottom 12 of cap part 10;

4—Positioning of the diaphragm 24 of the sealing part 16 and its sealing bead-shaped geometry 26 respectively relative to the through-hole 18.

This may be achieved, according to the invention, if a) the material for the sealing part 16 has a Shore hardness according to ISO 868 of 10 to 60 Shore A, preferably of 20 to 50 Shore A, particularly preferred from 30 to 40 Shore A, as well as b) the diameter of the through-hole 18 is at least 6 mm and at most 8 mm, preferably at least 6.2 mm and at most 7.0 mm, particularly preferred at least 6.2 mm and at most 6.8 mm, as well as c) the elastomeric sealing part 16 fills the through-hole 18 of the cap part 10 or at least is in direct contact with its edge and is attached to the bottom 12 preferably through substance bonding, for example through welding or adhesive bonding, and/or d) in the instance of the embodiment according to FIG. 5 or FIG. 6 the difference D of the diameter of the through-hole 18 and of the free internal diameter at the geometry 26 of the sealing part 16 is greater than 1.5 mm, preferably greater than 2 mm, particularly preferred greater than 2.5 mm.

The reduction of the actuating force during insertion of the insertion part 22 is achieved through a particular embodiment of the sealing part 16. The diaphragm 24 is made either very thin or, for example, is weakened through slots or perforations.

As depicted, for example, in FIG. 3*a* and in FIG. 3*b*, it is possible to provide in the cap housing, besides the sealing part 16, a second elastomeric, stopper-shaped sealing part 38 at a further through-hole in cap part 10, which is also covered by the strap 30. The sealing part 38, which also has an axially protruding, sealing ring-shaped geometry for making contact with the head diaphragm 8 of the container head part 6, may be pierced for admixture of an additive to the container contents or for removal of the content by means of an injection cannula.

Exemplary Embodiments

The following examples (tests No. 1-No. 43) provide further explanations to the invention. Into cap parts 10 according to FIG. 6, made from polypropylene Purell RP 270G by LyondellBasell, with different diameters of the through-hole 18, elastomeric sealing elements 16 with different free internal diameters of the sealing bead-shaped geometry 26 made from different elastomers and different Shore hardness were inserted and attached to the bottom 12 of the cap part 10. When using polyisoprene as sealing element 16, the sealing elements were adhesively bonded. When using thermoplastic elastomers (TPE) the sealing elements were laser-welded after being pressed into the cap part 10.

To be able to measure piercing forces independent from the head diaphragm 8 of the container, the cap parts were not welded to the container but were tested without them.

The maximum penetration forces (insertion forces) and dynamic retaining forces (retraction forces) were determined, similar to the description in DIN ISO 15759, with a universal testing machine Class 1 according to ISO 7500-1 with unused, commercially available insertion parts similar to ISO 8536-4 from different manufacturers as well as with the reference mandrel according to DIN ISO 15759 Appendix I. They have three different external diameters (5.4 mm, 5.6 mm and 6.0 mm). The test speed was 200 mm per minute according to the standard EN ISO 15747:2012.

The results, which are average values from 5 to 10 measurements, are compiled in the following table. The fourth column (column D) of this table is calculated from the diameter at the through-hole 18 at the strap end, less the free internal diameter at the geometry 26 of sealing part 16.

| Test No. | Diameter opening in cap part In mm | External diameter of insertion part In mm | D In mm | Hardness of sealing part Shore A | Insertion force E In N | Retraction force A In N | Ratio of forces A:E |
|---|---|---|---|---|---|---|---|
| 1 | 6.8 | 6.0 | 1 | 30 | 12.3 | 8.0 | 0.65 |
| 2 | 6.6 | 5.6 | 2.6 | 60 | 48.6 | 31.9 | 0.66 |
| 3 | 7.0 | 5.6 | 3 | 60 | 50.3 | 33.7 | 0.67 |
| 4 | 6.0 | 5.6 | 2 | 60 | 46.1 | 31.9 | 0.69 |
| 5 | 7.0 | 5.6 | 3 | 40 | 35.4 | 24.8 | 0.70 |
| 6 | 8.0 | 6.0 | 2.5 | 30 | 27.4 | 19.3 | 0.70 |
| 7 | 6.2 | 5.6 | 2.2 | 60 | 45.7 | 32.7 | 0.72 |
| 8 | 6.8 | 5.6 | 2.8 | 50 | 32.9 | 24.9 | 0.76 |
| 9 | 6.8 | 5.6 | 2.8 | 60 | 49.4 | 38.0 | 0.77 |
| 10 | 6.8 | 6.0 | 1 | 40 | 15.4 | 12.0 | 0.78 |
| 11 | 6.0 | 6.0 | 2 | 30 | 30.9 | 25.1 | 0.81 |
| 12 | 6.8 | 6.0 | 1 | 50 | 17.0 | 14.0 | 0.82 |
| 13 | 6.2 | 5.6 | 2.2 | 50 | 33.4 | 27.6 | 0.83 |
| 14 | 6.8 | 5.6 | 1.5 | 30 | 15.1 | 12.5 | 0.83 |
| 15 | 6.4 | 5.6 | 2.4 | 60 | 42.9 | 35.6 | 0.83 |
| 16 | 6.6 | 5.6 | 2.6 | 50 | 31.8 | 27.1 | 0.85 |
| 17 | 6.8 | 5.4 | 4 | 50 | 49.9 | 42.6 | 0.85 |
| 18 | 7.0 | 6.0 | 2.5 | 30 | 29.0 | 25.5 | 0.88 |
| 19 | 6.8 | 6.0 | 1 | 60 | 20.5 | 18.6 | 0.91 |
| 20 | 8.0 | 5.6 | 4 | 50 | 35.2 | 33.7 | 0.96 |
| 21 | 6.4 | 5.6 | 2.4 | 50 | 36.3 | 35.6 | 0.98 |
| 22 | 6.8 | 5.4 | 4 | 60 | 48.6 | 47.9 | 0.99 |
| 23 | 6.0 | 5.6 | 2 | 50 | 32.8 | 32.7 | 1.00 |
| 24 | 6.8 | 5.4 | 2.5 | 50 | 32.0 | 35.9 | 1.12 |
| 25 | 6.8 | 5.4 | 2.5 | 60 | 35.5 | 42.3 | 1.19 |
| 26 | 6.0 | 5.6 | 2 | 30 | 27.6 | 32.9 | 1.19 |
| 27 | 7.0 | 5.6 | 3 | 30 | 25.4 | 33.7 | 1.33 |
| 28 | 6.6 | 5.6 | 2.6 | 30 | 24.0 | 31.9 | 1.33 |
| 29 | 6.2 | 6.0 | 2.2 | 30 | 31.8 | 43.3 | 1.36 |
| 30 | 6.8 | 5.4 | 4 | 30 | 40.0 | 56.7 | 1.42 |
| 31 | 6.8 | 5.4 | 2 | 30 | 18.5 | 27.6 | 1.49 |
| 32 | 6.4 | 6.0 | 2.4 | 40 | 29.4 | 44.2 | 1.50 |
| 33 | 6.8 | 5.4 | 2.8 | 30 | 25.1 | 39.7 | 1.58 |
| 34 | 6.8 | 5.6 | 2.8 | 30 | 23.0 | 38.0 | 1.65 |
| 35 | 6.4 | 5.6 | 2.4 | 30 | 27.4 | 47.0 | 1.72 |
| 36 | 6.8 | 5.4 | 3.5 | 30 | 31.2 | 54.2 | 1.74 |
| 37 | 6.8 | 6.0 | 2.8 | 30 | 28.7 | 50.9 | 1.77 |
| 38 | 6.6 | 5.4 | 2.6 | 30 | 29.0 | 52.7 | 1.82 |
| 39 | 6.8 | 5.4 | 4 | 40 | 28.3 | 52.0 | 1.84 |
| 40 | 6.2 | 5.6 | 2.2 | 30 | 25.1 | 46.2 | 1.84 |
| 41 | 6.6 | 6.0 | 2.6 | 30 | 26.3 | 48.7 | 1.85 |
| 42 | 6.8 | 5.4 | 2.5 | 40 | 25.0 | 48.7 | 1.95 |
| 43 | 6.8 | 5.4 | 2.8 | 30 | 23.4 | 52.2 | 2.23 |

Very advantageous ratios between retraction force A and insertion force E result, according to the invention, where the material for the sealing part has a hardness of between 30 and 40 Shore A, where the diameter of the through-hole in the cap part is between 6.2 mm and 6.8 mm, and where the difference D is at least 2.5 mm.

While various embodiments have been chosen to illustrate the invention, it will be understood by those skilled in the art that various changes and modifications can be made therein without departing from the scope of the invention as defined in the claims.

The invention claimed is:

1. A container, comprising:

a container body at least partially filled with contents;

a cap part being on the container body and having a through-hole in the cap part with a diameter of at least 6 mm and not greater than 8 mm; and a sealing part being penetratable from an outside of the cap part in an insertion direction with a predeterminable actuating force by a hollow spike-shaped insertion part for removal of the contents, permitting removal of the insertion part from the cap part with a predeterminable retraction force in a retraction direction opposite to the insertion direction, making the retraction force greater than the insertion force making unintended withdrawal of the insertion part from the cap part more difficult, having a Shore hardness of 10 to 60 Shore A, being elastomeric, being at least one in the through-hole or directly contacting an edge of the through-hole, being attached to a bottom of the end cap and having a bead-shaped internal geometry with a difference of the diameter of the through-hole and a free internal diameter of the internal geometry being greater than 1.5 mm, portions of the sealing part being capable of being drawn into the through-hole during retraction of the insertion part.

2. A container according to claim 1 wherein the container body is formed in a blow-fill-seal method and is closed at one end thereof with a pierceable diaphragm covered by the cap part.

3. A container according to claim 1 wherein a radial distance is between the through-hole and the insertion part inserted in the through-hole forming an annular duct between the cap part at the through-hole and the insertion part, the annular duct being free of the sealing part during insertion of the insertion part in the through-hole and being at least partially packed by the sealing part upon withdrawal of the insertion part from the through-hole so as to apply the greater retraction forced by applying an increased frictional force on the insertion part by the sealing part.

4. A container according to claim 1 wherein the through-hole and an outer circumference of the insertion part define an annular duct therebetween with the insertion part in the through-hole, the annular duct having a predeterminable axial length such that the annular duct is free of the sealing part during insertion of the insertion part in the through-hole and is completely packed upon withdrawal of the insertion part from the through-hole by a bead-shaped projection of the internal geometry being jammed into the annular duct so as to apply a clamping force on the insertion part inhibiting the withdrawal of the insertion part from the through-hole.

5. A container according to claim 1 wherein the sealing part extends between the cap part and a head part of the container body and comprises a recess being coaxial to the through-hole and extending in an axial direction of the through-hole.

6. A container according to claim 1 wherein the sealing part extends between the cap part and a head diaphragm of a head part of the container body and comprises a passage being disposed coaxial to the through-hole and extending in an axial direction of the through-hole.

7. A container according to claim 1 wherein the internal geometry has an annular bead-shaped protruding radially into an inside of a recess or a passage of the sealing part, the annular bead being jamable in an annular duct between the through-hole and the insertion part upon withdrawal of the insertion part from the cap part.

8. A container according to claim 1 wherein the sealing part has a recess closed by a piercing diaphragm of the container body, the piercing diaphragm being pierceable by the insertion part.

9. A container according to claim 1 wherein the sealing part comprises an axial extension sealed and braced against a facing upper side of a head diaphragm of the container body.

10. A container according to claim 1 wherein the through-hole is covered toward surroundings of the container body by a detachable strap.

11. A container according to claim 10 wherein the detachable strap is a foil.

12. A container according to claim 1 wherein the cap part is attached to a rim part of the container body located below a head part of the container body.

13. A container according to claim 1 wherein an additional sealing part is housed in the cap part for passage of a cannula.

14. A cap part for a container, the cap part comprising:

a cap body having a through-hole in the cap body with a diameter of at least 6 mm and not greater than 8 mm; and a sealing part being in the cap body, being penetrable by an insertion part, having a recess sealed by a piercing diaphragm separating an annular bead from an axial sealing ring of the sealing part, being penetratable from an outside of the cap body in an insertion direction with a predeterminable actuating force by a hollow spike-shaped insertion part, permitting removal of the insertion part from the cap part body with a predeterminable retraction force in a retraction direction opposite to the insertion direction, making the retraction force greater than the insertion force making unintended withdrawal of the insertion part from the cap body more difficult, having a Shore hardness of 10 to 60 Shore A, being elastomeric, being at least one of in the through-hole or directly contacting an edge of the through-hole, being attached to a bottom of the cap body, and having a bead-shaped internal geometry with a difference of the diameter of the through-hole and a free internal diameter of the internal geometry being greater than 1.5 mm, portions of the sealing part being outside of the through-hole during insertion of the insertion part in the through-hole and is-being capable of being drawn into the through-hole during retraction of the insertion part.

15. A cap part according to claim 14 wherein the sealing part has an at least partial circumferential annular groove.

16. A cap part according to claim 14 wherein the Shore hardness is between 20 and 50 Shore A.

17. A cap part according to claim 14 wherein the Shore hardness is between 30 and 40 Shore A.

18. A cap part according to claim 14 wherein the diameter of the through-hole is at least 6.2 mm and not greater than 7 mm.

19. A cap part according to claim 14 wherein the diameter of the through-hole is at least 6.2 mm and not greater than 6.8 mm.

20. A cap part according to claim 14 wherein the sealing part is attached by bonding to a bottom of the cap body directly adjacent the through-hole by at least one of welding or adhesive bonding.

21. A cap part according to claim 14 wherein the difference is more than 2 mm.

22. A cap part according to claim 14 wherein the difference is more than 2.5 mm.

23. A cap part according to claim 14 wherein the through-hole is tapered toward a strap on an end of the cap body remote from the sealing part.

24. A cap part according to claim 14 wherein the through-hole is at least partially packed by the sealing part.

* * * * *